US011024945B2

(12) United States Patent
Wu

(10) Patent No.: US 11,024,945 B2
(45) Date of Patent: Jun. 1, 2021

(54) ANTENNA SYSTEM AND MOBILE TERMINAL

(71) Applicant: AAC Technologies Pte. Ltd., Singapore (SG)

(72) Inventor: Jing Wu, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 106 days.

(21) Appl. No.: 16/233,423

(22) Filed: Dec. 27, 2018

(65) Prior Publication Data

US 2019/0229429 A1 Jul. 25, 2019

(30) Foreign Application Priority Data

Jan. 25, 2018 (CN) ..... 201810071729.6

(51) Int. Cl.

| | |
|---|---|
| ***H01Q 13/10*** | (2006.01) |
| ***H01Q 5/35*** | (2015.01) |
| ***H01Q 21/28*** | (2006.01) |
| ***H01Q 1/24*** | (2006.01) |

(52) U.S. Cl.

CPC ..... *H01Q 1/243* (2013.01); *H01Q 5/35* (2015.01); *H01Q 13/106* (2013.01); *H01Q 21/28* (2013.01)

(58) Field of Classification Search

CPC ..... H01Q 1/243; H01Q 1/521; H01Q 5/35; H01Q 13/10; H01Q 13/106; H01Q 13/16; H01Q 21/28

See application file for complete search history.

(56) References Cited

U.S. PATENT DOCUMENTS

| | | | | |
|---|---|---|---|---|
| 2014/0184450 | A1* | 7/2014 | Koo | H01Q 5/335 343/702 |
| 2014/0347227 | A1* | 11/2014 | Iellici | H01Q 1/243 343/702 |
| 2015/0372372 | A1* | 12/2015 | Lee | H01O 1/243 343/702 |
| 2017/0093022 | A1* | 3/2017 | Cai | H01Q 21/28 |

* cited by examiner

*Primary Examiner* — Robert Karacsony

(74) *Attorney, Agent, or Firm* — IPro, PLLC; Na Xu

(57) ABSTRACT

Embodiments of the present disclosure relate to the field of communications technologies, and disclose an antenna system and a mobile terminal. The antenna system is applied to the mobile terminal. The mobile terminal includes a metal frame and a metal middle frame accommodated in the metal frame and connected to the metal frame, and the antenna system includes at least one antenna group formed on the metal middle frame and the metal frame, and each antenna group includes a first antenna and a second antenna away from each other, where the first antenna and the second antenna are spaced away from each other along a circumferential direction of the metal frame. In the present disclosure, at least one antenna group is added to the terminal based on the original structure, ensuring that the terminal can satisfy a multi-band working requirement and a data transmission requirement.

11 Claims, 9 Drawing Sheets

ANTENNA SYSTEM AND MOBILE TERMINAL

CROSS-REFERENCE TO RELATED APPLICATIONS

This application claims the priority benefit of Chinese Patent Applications Ser. No. 201810071729.6 filed on Jan. 25, 2018, the entire content of which is incorporated herein by reference.

TECHNICAL FIELD

Embodiments of the present disclosure relate to the field of communications technologies, and in particular, to an antenna and a mobile terminal.

BACKGROUND

With constant development of communications technologies, the fifth-generation (5G) mobile communications technology appears behind the cool and hot technologies such as virtual reality, drones, and automatic driving. The fifth-generation mobile communications technology is an extension of 4G, and is being researched. A theoretical downlink speed of a 5G network is 10 Gb/s (which is equivalent to a download speed of 1.25 GB/s). With regard to capacities, mobile data traffic of the 5G communications technology increases by 1000 times than that of 4G per unit area. While with regard to transmission rates, a typical user data rate increases by 10 times to 100 times, and a peak transmission rate can reach 10 Gbps (where a peak transmission rate of 4G is 100 Mbps). As can be seen, 5G will fully surpass 4G in all aspects and achieve a real integrated networks.

The International Telecommunication Union (ITU) specified the main application scenarios of 5G at the $22^{nd}$ ITU-RWP5D Conference held in June 2015. The ITU defined three main application scenarios of 5G: enhanced Mobile Broadband (eMBB), large-scale machine Communication, and high Reliable and Low Latency Communication (HRLLC). The three application scenarios respectively correspond to different key indicators, where in the eMBB scenario, a user's peak rate is 20 Gbps, and a lowest user experience rate is 100 Mbps.

The inventor finds out that at least the following problems exist in the prior art: the existing mobile terminal design tends to a structure of a full screen, a ceramic or glass rear housing, and a metal middle frame. For a full-screen communications device, a conventional antenna layout space is very limited. Therefore, it is very difficult to dispose more antennas of more bands. In addition, in a multi-frequency band antenna layout, isolation and correlation requirements between antennas also need to be considered, which further increasing the design difficulty.

BRIEF DESCRIPTION OF THE DRAWINGS

One or more embodiments are exemplified by tdrawings corresponding to the accompanying drawings. The exemplary descriptions do not constitute any limitation to the embodiments. Elements with a same reference numeral in the accompanying drawings represent similar elements. Unless otherwise stated, the drawings in the accompanying drawings constitute no proportional limitation.

DETAILED DESCRIPTION

To make the objectives, technical solutions, and advantages of embodiments of the present disclosure clearer, the following further describes the embodiments of the present disclosure in detail with reference to the accompanying drawings. However, a person of ordinary skill in the art may understand that in the embodiments of the present disclosure, to make a reader understand the present disclosure better, many technical details are provided. However, various changes and modifications without these technical details and based on the following embodiments the present disclosure can also implement the technical solutions protected by the present disclosure.

Figure 1:
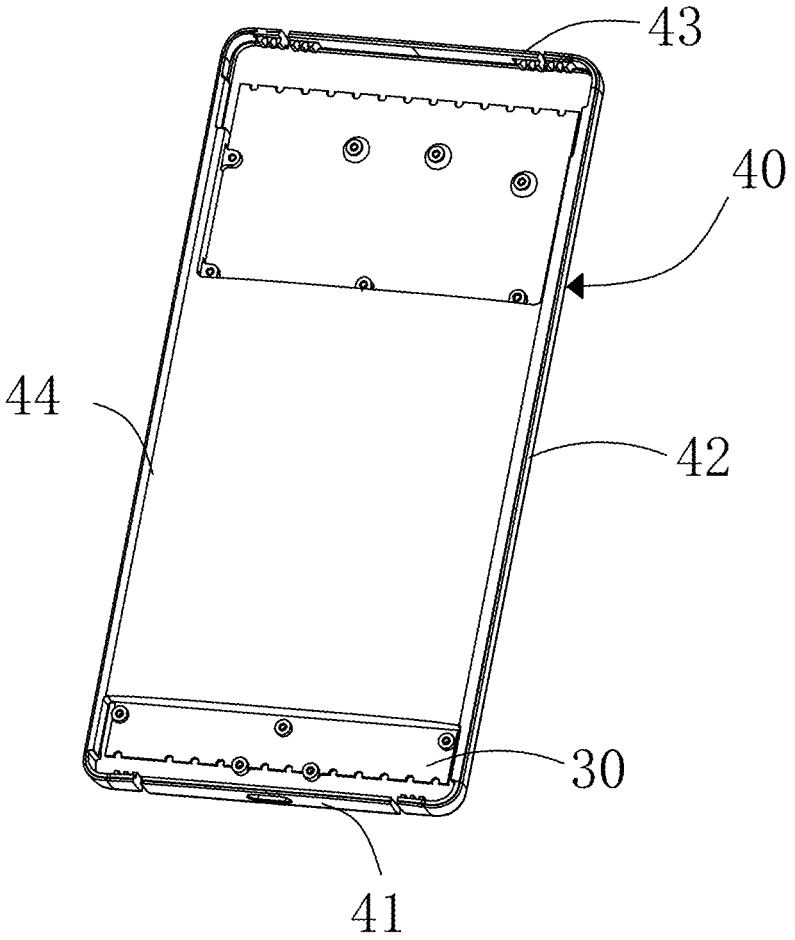
FIG. 1 is a schematic structural diagram of a mobile terminal according to a first embodiment of the present disclosure.

A first embodiment of the present disclosure relates an antenna system, applied to a mobile terminal. A structure thereof is shown in FIG. 1. The mobile terminal includes a metal frame 40 and a metal middle frame 30 accommodated in the metal frame 40 and connected to the metal frame 40. In FIG. 1, the metal frame 40 includes two opposite long sides and two short sides connecting the long sides, which are a first short side 41, a first long side 42, a second short side 43, and a second long side 44, respectively.

Figure 2:
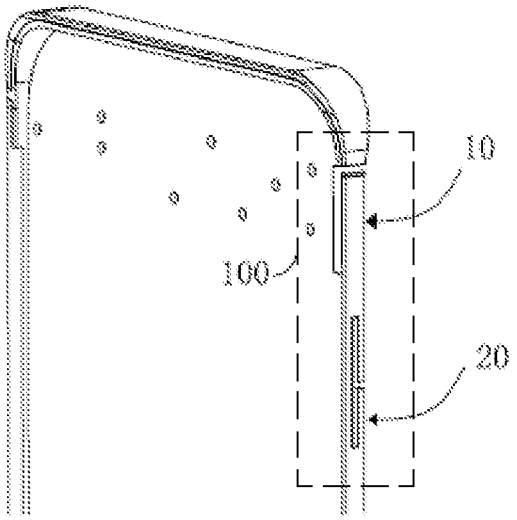
FIG. 2 is a schematic structural diagram of an antenna system according to a first embodiment of the present disclosure.
Figure 3:
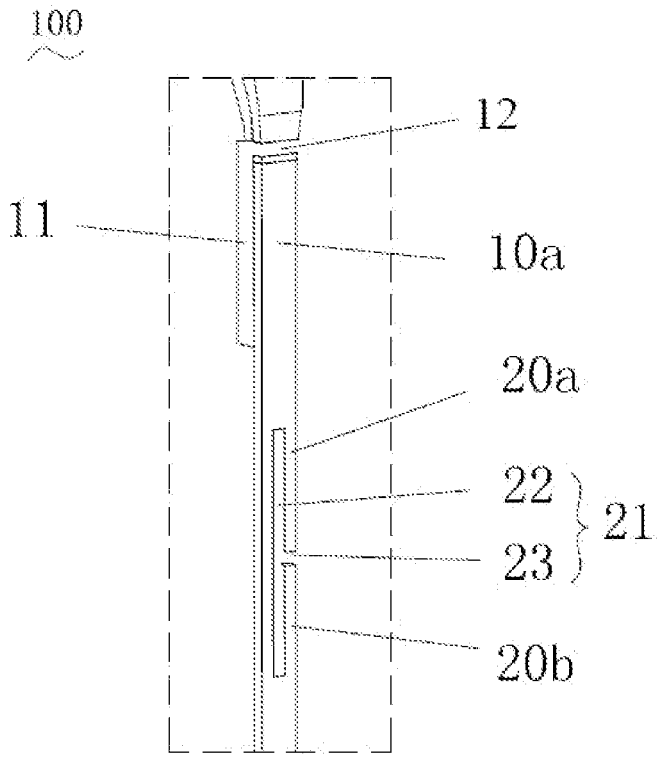
FIG. 3 is a schematic structural diagram of an antenna group according to a first embodiment of the present disclosure.
Figure 4:
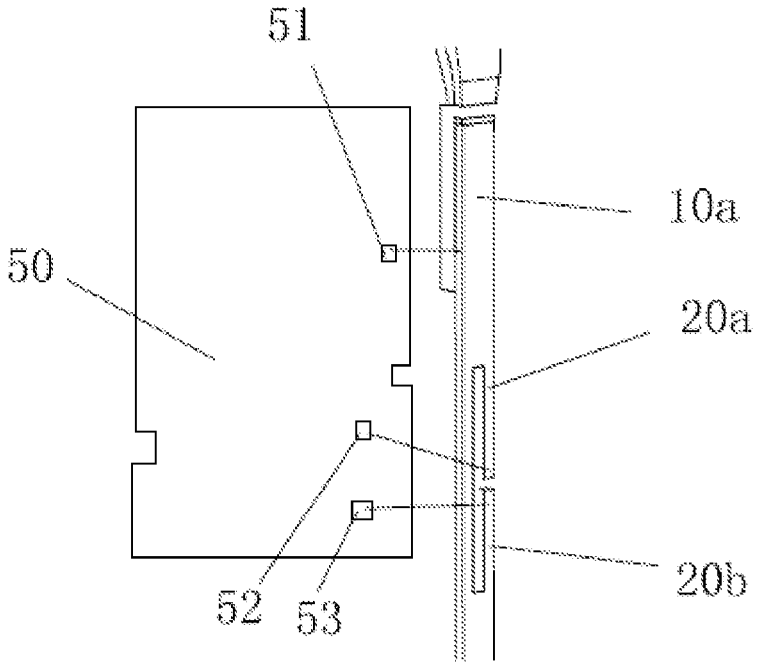
FIG. 4 is a schematic diagram of a connection between an antenna group and a circuit board according to a first embodiment of the present disclosure.

As shown in FIG. 2, FIG. 3, and FIG. 4, the antenna system includes at least one antenna group 100, and each antenna group includes a first antenna 10 and a second antenna 20.

The first antenna 10 includes a first antenna slot 11 disposed at a position of the metal middle frame 30 interfacing with the metal frame 40, a gap 12 disposed on the metal frame 40 and in communication with an end of the first antenna slot 11, and a first radiation arm 10*a* formed on the metal frame 40.

The first antenna slot 11 extends along a circumferential direction of the metal frame 40, one end of the first radiation arm 10*a* is connected to the gap 12, and the other end of the first radiation arm 10*a* is connected to the other end of the first antenna slot 11 away from the gap 12.

The second antenna 20 includes a second antenna slot 21 disposed on the metal frame 40, where the second antenna slot 21 includes a first slit 22 and a second slit 23 in communication with the first slit 22, and the first slit 22 extends along the circumferential direction of the metal frame 40, and the second slit 23 extends along a direction perpendicular to the first slit 22, to divide the metal frame 40 located at an edge of the first slit 22 into a first branch 20*a* and a second branch 20*b*.

The first antenna 10 and the second antenna 20 are spaced away from each other along the circumferential direction of the metal frame 40.

The antenna system further includes a circuit board 50 disposed on the metal middle frame 30, where the circuit board 50 is provided with a first feed point 51, a second feed point 52, and a first ground point 53. Wherein the first feed point 51 is electrically connected to the first radiation arm 10*a*, to perform feeding for the first antenna 10. The second feed point 52 is connected to an end of the first branch 20*a* close to the second slit 23. The first ground point 53 is connected to an end of the second branch 20*b* close to the second slit 23, for the second antenna 20 to perform feeding and be grounded.

Specifically, the gap 12 of the first antenna 10 is disposed at an end of the first antenna slot 11 away from the second antenna 20. An electromagnetic wave of the first antenna 10 is radiated through the gap 12. Therefore, the gap 12 is provided away from the second antenna 20, which helps improve isolation between the first antenna 10 and the second antenna 20. It should be noted that the gap 12 may be formed in design of a mobile terminal ID, or may be formed specifically for the first antenna 10. Therefore, the gap 12 corresponding to the first antenna 10 may be set flexibly as required.

A conventional main antenna, diversity antenna, GPS antenna, and Wi-Fi antenna are usually disposed on the short sides of the metal frame 40. Therefore, in this embodiment, the first antenna 10 and the second antenna 20 are preferably disposed on the long sides, to avoid a conventional antenna area. Specifically, the first antenna 10 and the second antenna 20 both may be formed on the first long side 42, or may be formed on the second long side 44.

Specifically, the first antenna slot 11 has a width of not greater than 1 mm, and the first slit 22 and the second slit 23 both have a width of not greater than 1 mm. It should be noted that values given in this embodiment are preferable values, and the widths of the first antenna slot 11, the first slit 22, and the second slit 23 are not limited to the values in this embodiment.

In this embodiment, the antenna system is a multiple-input multiple-output (MIMO) antenna system, and the mobile terminal may be provided with at least one antenna group 100. The metal frame 40 and the metal middle frame 30 of the mobile terminal are fully used to improve data transmission efficiency of the terminal and improve communication quality of the terminal.

Figure 5:
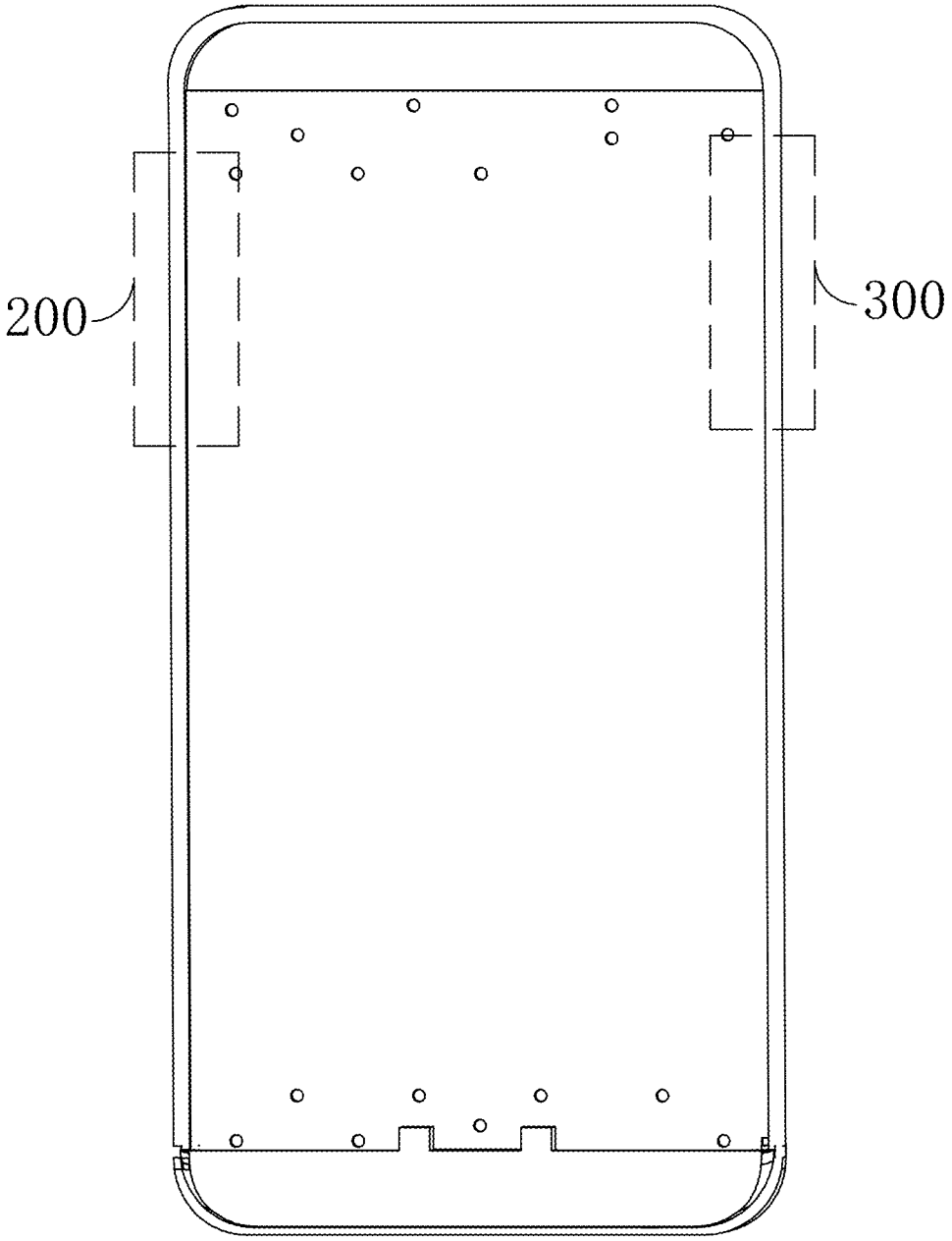
FIG. 5 is a schematic structural diagram of another antenna system according to a first embodiment of the present disclosure.
Figure 6:
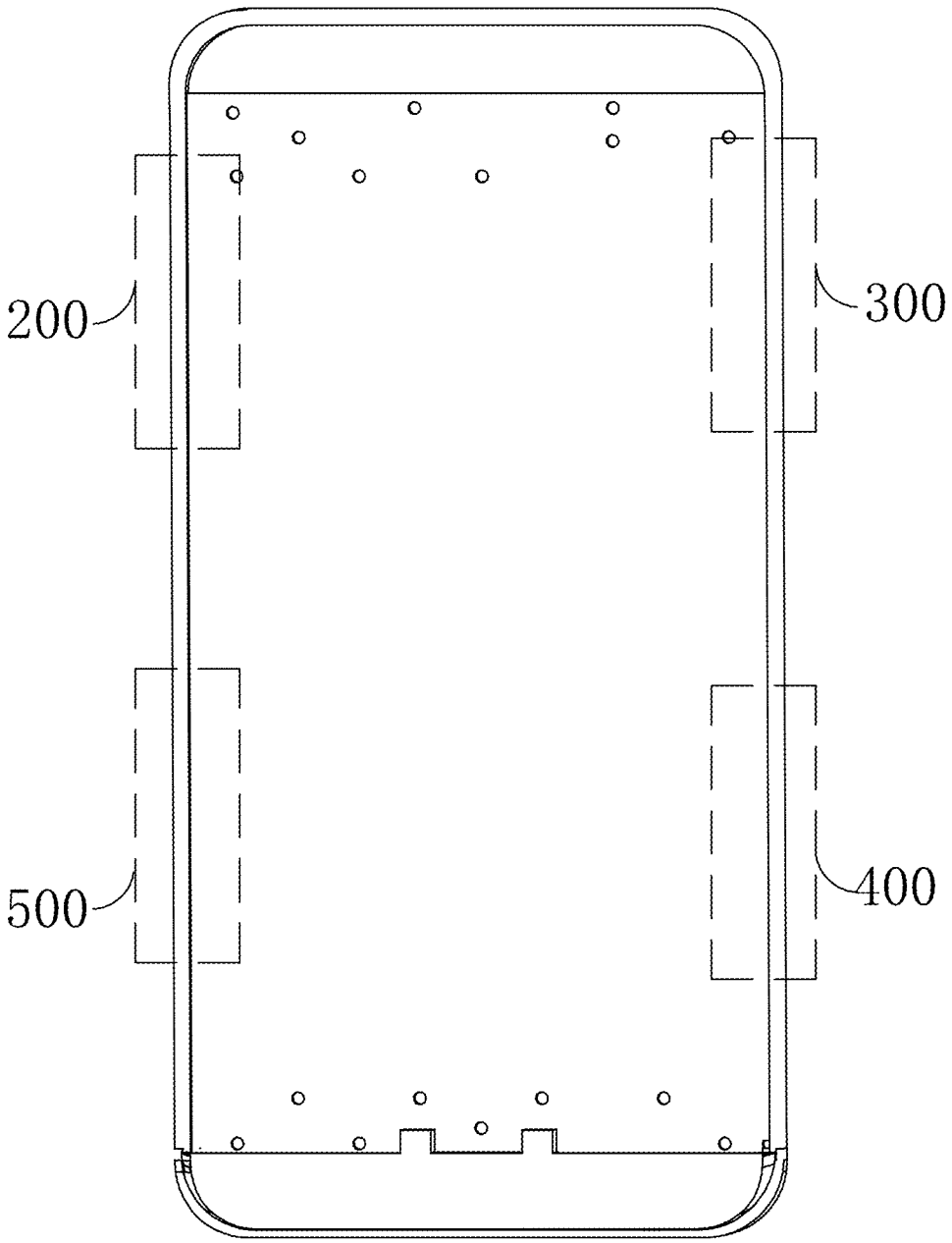
FIG. 6 is a schematic structural diagram of another antenna system according to a first embodiment of the present disclosure.

Specifically, the mobile terminal may be provided with a plurality of antenna groups. As shown in FIG. 5, the antenna system is a 4*4 antenna group. A terminal frame on a left side of the figure is provided with an antenna group 200, a terminal frame on a right side of the figure is provided with an antenna group 300, and each antenna group has two antennas. In addition, as shown in FIG. 6, the antenna system may alternatively be provided with an 8*8 antenna group. Specifically, antenna groups 200 and 500 may be disposed on a left side, and antenna groups 300 and 400 are disposed on a right side. The descriptions herein are merely examples, a specific quantity and position of the antenna group may be set according to a data transmission requirement or a communication quality requirement of the terminal. Specific structures of the antenna group 200, the antenna group 300, the antenna group 400, and the antenna group 500 are the same as or similar to a specific structure of the antenna group 100.

Compared with the prior art, the provided antenna system can improve a data transmission capacity and increase data transmission channels without affecting an existing antenna, and each antenna group in the antenna system includes two antennas having different radiation mechanisms. In addition, the two antennas are not in contact with each other, and therefore, respective signal transmission is not affected, thereby ensuring good isolation.

In this embodiment, the first antenna 10 and the second antenna 20 have a same working frequency band, which covers 3300 MHz to 3600 MHz and 4800 MHz to 5000 MHz.

Figure 7:
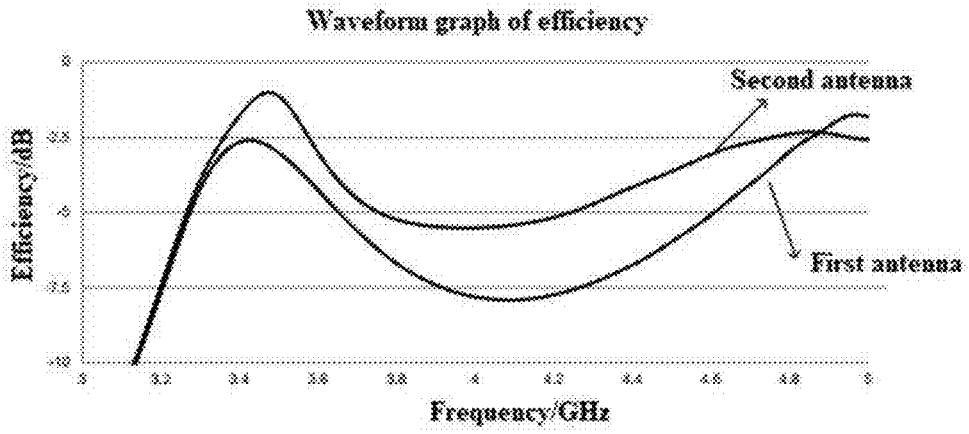
FIG. 7 is a waveform graph of radiation efficiency of a first antenna and a second antenna according to a first embodiment of the present disclosure.
Figure 8:
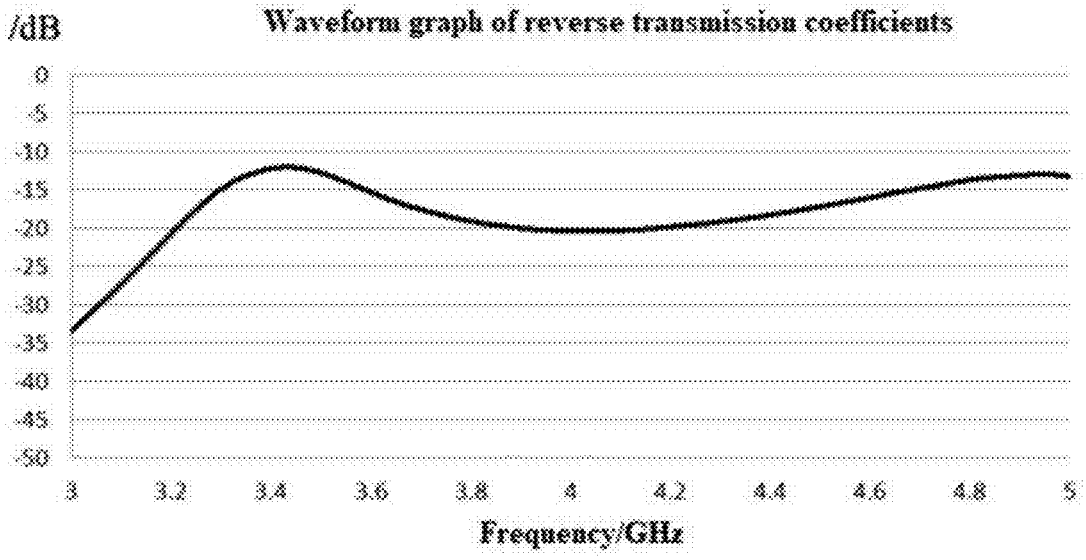
FIG. 8 is a waveform graph of reverse transmission coefficients of a first antenna and a second antenna according to a first embodiment of the present disclosure.
Figure 9:
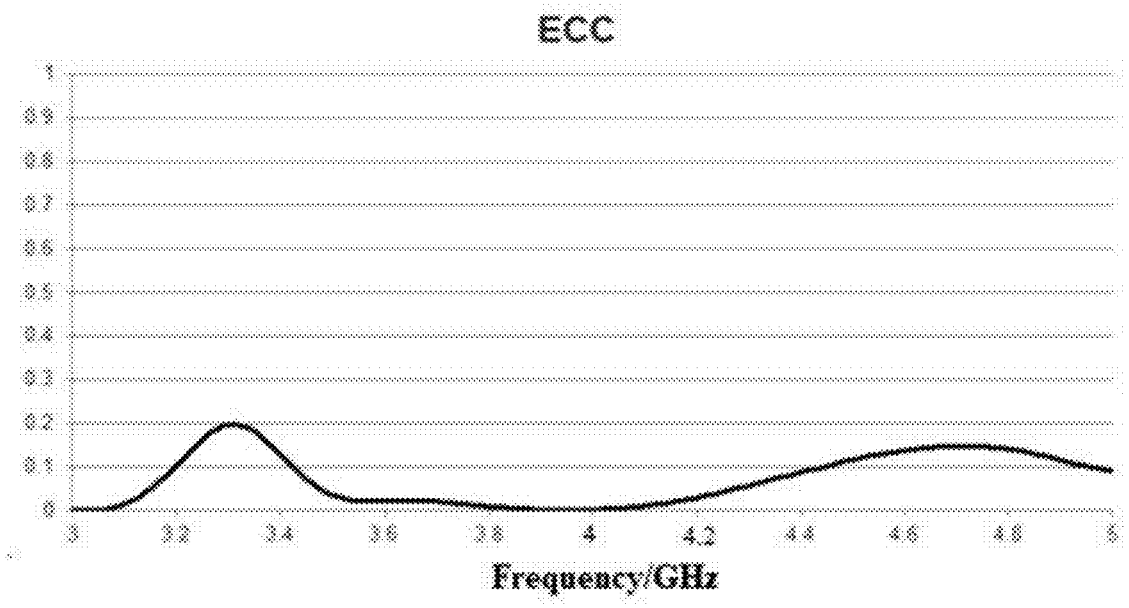
FIG. 9 is a waveform graph of Envelope Correlation Coefficient (ECC) of a first antenna and a second antenna according to a first embodiment of the present disclosure.

Working radiation efficiency of the first antenna 10 and the second antenna 20 are shown in FIG. 7. The radiation efficiency of the first antenna 10 and the second antenna 20 at working frequencies corresponding to the first antenna 10 and the second antenna 20 in the foregoing specific embodiment is relatively high, and is at least −7.5 dB. Reverse transmission coefficients of the first antenna 10 and the second antenna 20 are shown in FIG. 8, wherein the reverse transmission coefficients of the two antennas at the working frequencies corresponding to the first antenna 10 and the second antenna 20 in the foregoing specific embodiment are below −10 dB. An ECC (Envelope Correlation Coefficient) waveform of the first antenna 10 and the second antenna 20 is shown in FIG. 9. At a corresponding working frequency band, the first antenna 10 and the second antenna 20 have relative good ECCs, which are below 0.05.

It should be noted that in other embodiments, the first antenna 10 and the second antenna 20 may be designed as other forms of antennas, for example, dual-band mono-pole antennas.

It should be noted that to highlight the disclosure parts of the present disclosure, a unit not closely related to the technical problem mentioned in the present disclosure is not provided in this embodiment, but this does not indicate that there are no other units in this embodiment.

A second embodiment of the present disclosure relates to a mobile terminal, including the antenna system in the first embodiment, and the mobile terminal has a full screen.

Specifically, the mobile terminal can work at a 5G band.

Compared with the prior art, the embodiments of the present disclosure can improve data transmission efficiency of a terminal having a full screen, improve communication quality of the terminal, and improve user experience by adding an antenna when an existing terminal has extremely limited space.

Certainly, the terminal should further include hardware such as a processor and a memory, Wherein the memory and the processor are connected through a bus, and the bus may include any quantity of interconnected buses and bridges, the bus links various circuits of one or more processors and memories together. The bus may further link various other circuits, such as a peripheral device, a voltage stabilizer, and a power management circuit. These are known in the art, and therefore are not further described in the present disclosure. A bus interface provides an interface between the bus and a phased array antenna system. Data processed by the processor is transmitted on wireless medium by using the phased array antenna system. Further, the phased array antenna system further receives data and transfers the data to the processor. The processor is responsible for managing the bus and usual processing, and may further provide various functions, including timing, a peripheral interface, voltage adjustment, power management, and other control functions. The memory may be configured to store data used by the processor to perform an operation.

A person of ordinary skill in the art may understand that the foregoing embodiments are specific examples for implementing the present disclosure. However, in practical application, forms and details of the foregoing embodiments may be changed in various manners without departing from the spirit and scope of the present disclosure.

What is claimed is:

1. An antenna system, applied to a mobile terminal, wherein the mobile terminal comprises a metal frame and a metal middle frame accommodated in the metal frame and connected to the metal frame, the antenna system comprises at least one antenna group formed on the metal middle frame and the metal frame, and each antenna group comprises a first antenna and a second antenna spaced away from each other; wherein the first antenna comprises a first antenna slot disposed at a position of the metal middle frame interfacing with the metal frame, a gap disposed on the metal frame and in communication with an end of the first antenna slot, and a first radiation arm formed on the metal frame, wherein the first antenna slot extends along a circumferential direction of the metal frame, one end of the first radiation arm is connected to the gap, and the other end of the first radiation arm is connected to the other end of the first antenna slot away from the gap;

the second antenna comprises a second antenna slot disposed on the metal frame, wherein the second antenna slot comprises a first slit and a second slit in communication with the first slit, where the first slit extends along the circumferential direction of the metal frame, and the second slit extends along a direction perpendicular to the first slit, to divide the metal frame located at an edge of the first slit into a first branch and a second branch; and the first antenna and the second antenna are spaced away from each other along the circumferential direction of the metal frame;

the gap of the first antenna is located at an end of the first antenna slot away from the second antenna.

2. The antenna system according to claim 1, wherein the antenna system further comprises a circuit board disposed on the metal middle frame, and the circuit board is provided with a first feed point, a second feed point, and a first ground point;

the first feed point is electrically connected to the first radiation arm, to perform feeding for the first antenna; and the second feed point is connected to an end of the first branch close to the second slit, and the first ground point is connected to an end of the second branch close to the second slit, to perform feeding and be grounded for the second antenna.

3. The antenna system according to claim 1, wherein the first antenna slot has a width of not greater than 1 mm, and the first slit and the second slit both have a width of not greater than 1 mm.

4. The antenna system according to claim 1, wherein the metal frame comprises two opposite long sides and two short sides connecting the long sides, and the first antenna and the second antenna are formed on the long side.

5. The antenna system according to claim 1, wherein a working frequency band of the first antenna covers 3300 MHz to 3600 MHz and 4800 MHz to 5000 MHz, and a working frequency band of the second antenna covers 3300 MHz to 3600 MHz and 4800 MHz to 5000 MHz.

6. The antenna system according to claim 1, wherein a working frequency band of the first antenna covers 3300 MHz to 3600 MHz and 4800 MHz to 5000 MHz, and a working frequency band of the second antenna covers 3300 MHz to 3600 MHz and 4800 MHz to 5000 MHz.

7. The antenna system according to claim 2, wherein a working frequency band of the first antenna covers 3300 MHz to 3600 MHz and 4800 MHz to 5000 MHz, and a working frequency band of the second antenna covers 3300 MHz to 3600 MHz and 4800 MHz to 5000 MHz.

8. The antenna system according to claim 3, wherein a working frequency band of the first antenna covers 3300 MHz to 3600 MHz and 4800 MHz to 5000 MHz, and a working frequency band of the second antenna covers 3300 MHz to 3600 MHz and 4800 MHz to 5000 MHz.

9. The antenna system according to claim 4, wherein a working frequency band of the first antenna covers 3300 MHz to 3600 MHz and 4800 MHz to 5000 MHz, and a working frequency band of the second antenna covers 3300 MHz to 3600 MHz and 4800 MHz to 5000 MHz.

10. A mobile terminal, comprising the antenna system according to claim 1.

11. A mobile terminal, comprising the antenna system according to claim 5.

* * * * *